US010537159B2

(12) United States Patent
Matz et al.

(10) Patent No.: US 10,537,159 B2
(45) Date of Patent: Jan. 21, 2020

(54) ADJUSTABLE GARMENT CLOSURE

(71) Applicant: The JEMZ Group, LLC, Elkins Park, PA (US)

(72) Inventors: Joshua Doron Matz, New York City, NY (US); Ellen Horowitz Matz, Elkins Park, PA (US)

(73) Assignee: THE JEMZ GROUP, LLC, Elkins Park, PA (US)

( * ) Notice: Subject to any disclaimer, the term of this patent is extended or adjusted under 35 U.S.C. 154(b) by 267 days.

(21) Appl. No.: 15/468,595

(22) Filed: Mar. 24, 2017

(65) Prior Publication Data

US 2017/0354211 A1 Dec. 14, 2017

Related U.S. Application Data

(60) Provisional application No. 62/392,849, filed on Jun. 13, 2016.

(51) Int. Cl.

| | |
|---|---|
| ***A44C 11/00*** | (2006.01) |
| ***A41F 1/00*** | (2006.01) |
| ***A44C 5/20*** | (2006.01) |
| ***A44C 25/00*** | (2006.01) |

(52) U.S. Cl.

CPC ..... *A44C 11/005* (2013.01); *A41F 1/002* (2013.01); *A44C 5/2052* (2013.01); *A44C 25/007* (2013.01)

(58) Field of Classification Search

CPC ... A44C 11/005; A44C 15/003; A44C 11/001; A44C 25/007; A44C 5/2052; A45F 2003/002; A45F 2005/006; A45F 2200/0541; A41F 1/002; Y10T 24/3902

See application file for complete search history.

(56) References Cited

U.S. PATENT DOCUMENTS 268,102 A * 11/1882 Horton ..... A44C 5/00 63/21
1,376,262 A * 4/1921 Denny ..... A45F 5/004 242/382
2,291,089 A * 7/1942 Okun ..... A44B 15/00 24/115 H
3,163,026 A * 12/1964 Kenny ..... A44C 15/0055 132/275

(Continued)

OTHER PUBLICATIONS

Creative Student Jewelry Exquisite Natu . . . ; Downloaded Jul. 24, 2018 from https://www.alibaba.com/product-detail/Creative-student-jewelry-Exquisite-natural-tiny_60668868749.html.

(Continued)

*Primary Examiner* — Robert Sandy
*Assistant Examiner* — Rowland Do
(74) *Attorney, Agent, or Firm* — BainwoodHuang

(57) ABSTRACT

A technique for closing garments provides a flexible line and a take-up component. The flexible line has a first end and a second end. Each end of the flexible line is coupled to a respective fastener, and each fastener is configured to attach to a respective garment portion, such as portions of a sweater, prayer shawl, scarf, or the like. The take-up component contains a segment of the flexible line and is adjustable to vary the segment's length. In this manner, a person can attach the two fasteners and adjust the take-up component to vary a degree of closure between the garment portions.

18 Claims, 5 Drawing Sheets

(56) References Cited

U.S. PATENT DOCUMENTS

| | | | | |
|---|---|---|---|---|
| 6,026,515 | A * | 2/2000 | Nielson | A44C 15/00 150/134 |
| 6,070,434 | A * | 6/2000 | Traver | A44B 6/00 2/129 |
| 7,721,571 | B2 * | 5/2010 | Rose | A44C 25/00 2/308 |
| 2003/0110798 | A1 * | 6/2003 | Ignatowski | A44C 15/001 63/38 |
| 2011/0271715 | A1 * | 11/2011 | Stone | A44B 1/04 63/1.18 |
| 2017/0095045 | A1 * | 4/2017 | Porfilio | A44C 5/185 |

OTHER PUBLICATIONS

20mm snaps KC1169 snaps jewelry; Downloaded Jul. 24, 2018 from https://www.partnerbeads.com/Metal_Badge_Reel_ID_holder_retractable_badge_holder_%EF%BC%88Stretchable_to_60CM%EF%BC%89_Fit_1820mm_snaps_KC1169_snaps_jewelry_p23115.html.

Sweater Clip _ eBay; Downloaded Jul. 24, 2018 from https://www.ebay.com/bhp/sweater-clip.

* cited by examiner

ADJUSTABLE GARMENT CLOSURE

CROSS-REFERENCE TO RELATED APPLICATIONS

This application claims priority to U.S. Provisional Application No. 62/392,849, filed Jun. 13, 2016, the contents and teachings of which are incorporated herein by reference in their entirety.

BACKGROUND

Jewelry items often serve practical purposes in addition to being decorative. For example, cufflinks keep shirt sleeves closed and chains keep pocket watches tethered to vests.

SUMMARY

The universe of practical applications for jewelry items has left many areas unexplored. A particular case is presented by sweaters, prayer shawls, scarves, and similar garments. When worn, these garments typically have left and right sides, such as left and right front panels. Sometimes a person might prefer to close the two sides of a garment tightly. Other times the person may wish to leave some space between the two sides, such that the garment is left partially open. The desired amount of open space may vary based on temperature, fashion, activity level of the person wearing the garment, and other factors. Designers may provide buttons, clasps, or zippers, but such closures are generally nonadjustable, adjustable only to a small degree, or adjustable only at predetermined lengths, which may or may not be to the liking of the wearer.

In contrast with previous approaches, an improved technique for closing garments provides a flexible line and a take-up component. The flexible line has a first end and a second end. Each end of the flexible line is coupled to a respective fastener, and each fastener is configured to attach to a respective garment portion, such as portions of a sweater, prayer shawl, scarf, or the like. The take-up component contains a segment of the flexible line and is adjustable to vary the segment's length. In this manner, a person can attach the two fasteners to the garment and adjust the take-up component to vary a degree of closure between the garment portions. Sometimes, the person may tightly close the garment portions, while other times the person may leave space. The person may adjust the amount of space as desired.

In some examples, the flexible line is a jewelry-grade chain or cord, and the fasteners are adorned with jewelry items, such that visible portions of the fasteners serve a decorative function. In some examples, the flexible line itself provides a medium for holding charms or other decorative items, such that exposed areas of the flexible line can be made even more attractive and/or fanciful.

Certain embodiments are directed to an adjustable garment closure. The adjustable garment closure includes a flexible line composed of a chain or cord, the flexible line having a first end and a second end. A first fastener is coupled to the first end of the flexible line and is configured to attach the first end of the flexible line to a first garment portion. A second fastener is coupled to the second end of the flexible line and is configured to attach the second end of the flexible line to a second garment portion. Further, a take-up component is coupled to the flexible line and/or to the first fastener and contains a segment of the flexible line. The take-up component is adjustable to vary a length of the segment contained by the take-up component and thereby to effect a variable closure of the first garment portion relative to the second garment portion.

Other embodiments are directed to a method of applying a flexible garment closure. The method includes attaching a first fastener to a first garment portion, the first fastener coupled to a first end of a flexible line, the flexible line composed of a chain or cord. The method further includes attaching a second fastener to a second garment portion, the second fastener coupled to a second end of the flexible line. The method still further includes adjusting a take-up component coupled to the flexible line to vary a length of a segment of the flexible line contained by the take-up component. Adjusting the take-up component effects a variable closure of the first garment portion relative to the second garment portion.

The foregoing summary is presented for illustrative purposes to assist the reader in readily grasping example features presented herein; however, this summary is not intended to set forth required elements or to limit embodiments hereof in any way. One should appreciate that the above-described features can be combined in any manner that makes technological sense, and that all such combinations are intended to be disclosed herein, regardless of whether such combinations are identified explicitly or not.

BRIEF DESCRIPTION OF THE SEVERAL VIEWS OF THE DRAWINGS

The foregoing and other features and advantages will be apparent from the following description of particular embodiments of the invention, as illustrated in the accompanying drawings, in which like reference characters refer to the same or similar parts throughout the different views. The drawings are not necessarily to scale.

DETAILED DESCRIPTION OF THE INVENTION

Embodiments of the invention will now be described. It should be appreciated that such embodiments are provided by way of example to illustrate certain features and principles of the invention but that the invention hereof is not limited to the particular embodiments described.

An improved technique for closing garments provides a flexible line and a take-up component. Each end of the flexible line is coupled to a respective fastener. Each fastener is configured to attach to a respective garment portion, such as left and right sides of a sweater, prayer shawl, scarf, or the like. The take-up component contains a segment of the flexible line and is adjustable to vary a length of the segment contained therein.

Figure 1:
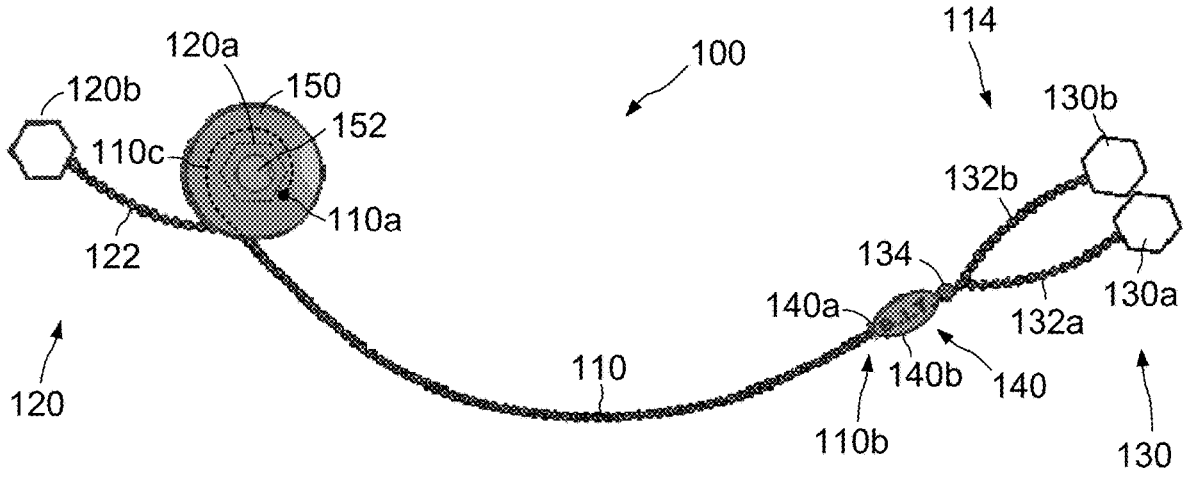
FIG. 1 is a front, plan view of an adjustable garment closure in accordance with an embodiment of the invention.

FIG. 1 shows an adjustable garment closure 100 in accordance with an embodiment of the invention. Here, a flexible line 110, such as a chain or cord, has a first end 110*a* and a second end 110*b*. The flexible line 110 is coupled to a first fastener 120 at the first end 110*a* and to a second fastener 130 at the second end 110*b*. In the example shown, the first end 110*a* of the flexible line 110 is attached to an internal portion of a take-up component 150, such that a segment 110*c* of the flexible line 110 is contained within the take-up component 150. The take-up component 150 has a control, such as a button 152, which a person can operate to adjust the length of the contained segment 110*c*. In an example, the take-up component 150 includes a spring or other biasing element arranged to retract the flexible line 110 into the take-up component 150 by desired amounts in response to the person pressing the button 152.

In the example shown, the first fastener 120 includes a first element 120*a* and a second element 120*b*. The first element 120*a* may be affixed to the back of the take-up component 150 (as shown), or it may be integral with the take-up component 150. For example, the take-up component may itself be composed, at least in part, of a magnetic material that performs the function of the first element 120*a*. When placed on either side of a portion of a garment, the elements 120*a* and 120*b* attract each other through the garment portion and hold the garment portion in a fixed arrangement by friction.

To avoid accidental loss of the second element 120*b*, the second element 120*b* may be attached to the take-up component 150 or to the flexible line 110 via a chain or cord 122. For consistency of appearance, the chain or cord 122 may match the flexible line 110 in its composition and design.

The second fastener 130 also includes two elements, 130*a* and 130*b*. The elements 130*a* and 130*b* are also magnetic and are configured to hold a second garment portion between them using friction. In the example shown, the elements 130*a* and 130*b* are each coupled to the second end 110*b* of the flexible line 110 via respective chains or cords, 132*a* and 132*b*. For consistency of appearance, the chains or cords 132*a* and 132*b* may also match the flexible line 110 in composition and design.

In some examples, the adjustable garment closure 100 may also include a clasp 140. In the example shown, the clasp 140 is placed at the second end 110*b* of the flexible line 110. The clasp 140 may include a male part 140*a* and a female part 140*b*. The two parts 140*a* and 140*b* may be engaged or disengaged by the user. The clasp 140 serves the practical purpose of enabling the user to quickly remove or put on the garment without having to remove or reattach the fasteners 120 and 130. The clasp 140 also allows the user to readily add, remove, or rearrange charms on the flexible line 110. One should appreciate that various types of clasps and/or hooks may be used with similar effect, and that the particular clasp 140 as shown is merely illustrative.

The length of the flexible line 110 and the lengths of the chains or cords 122, 132*a*, and 132*b* may be varied according to the size of the wearer, the type or style of the garment involved, and/or other factors. The chains or cords 122, 132*a*, and 132*b* are typically shorter than the flexible line 110. In a particular example, the chains or cords 122, 132*a*, and 132*b* are approximately 5 cm long and the flexible line 110 is approximately 20 cm long.

The features of the adjustable closure 100 may be varied from the particular details described above. For example, the fasteners 120 and 130 may use pins and sockets instead of magnets for attaching to garment portions. In a particular example, each fastener is simply a pin, which attaches directly to a garment portion without a socket. Further, the first end 110*a* of the flexible line 110 need not be contained by the take-up component 150. Rather, the take-up component 150 may be disposed anywhere along the length of the flexible line 110. In cases where the first end 110*a* is not disposed within the take-up component 150, the chain or cord 122 may simply be a continuation of the flexible line 110, rather than a separate element. Instead of being operated using a button 152, the take-up component 150 may alternatively employ a crank, which the user may rotate to adjust the exposed length of the flexible line 110. Also, different types of take-up components may be used. For example, a funnel-like adapter may receive two strands of the flexible line 110 from two opposing directions and provide a loop of the flexible line 110 that extends in a third direction. The flexible line 110 and chains/cords 122, 132*a*, and 132*b* may be composed of any suitable material, such as a precious metal (e.g., gold, silver, platinum, etc.), another metal or combination of metals, natural fibers, synthetic fibers, plastic, and the like. Such materials may be provided in chains, ropes, braids, wires, or in any other flexible, linear arrangement.

As will be described more fully below, the adjustable garment closure 100 may be adorned with various jewelry items. For example, the fastener elements may include designs similar to those that might be found on a pin or brooch. Such jewelry elements may be integral with the respective fastener element or may be attached to the fastener elements via buttons, snaps, adhesive, or the like. In some examples, the jewelry items are removable from the fastener elements, such that they may be exchanged with others to vary the appearance of the adjustable closure 100. Also, in some examples, the flexible line 110 may serve as a medium for carrying charms or other ornaments.

Figure 2:
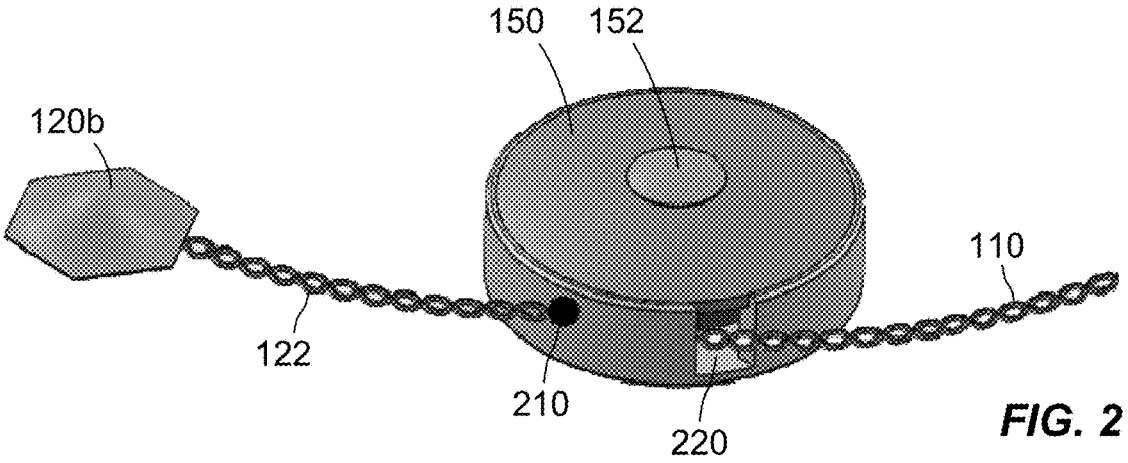
FIG. 2 is a perspective view of an example first fastener of the adjustable garment closure of FIG. 1, where an element of the first fastener is coupled to a take-up component via a chain or cord.
Figure 3:
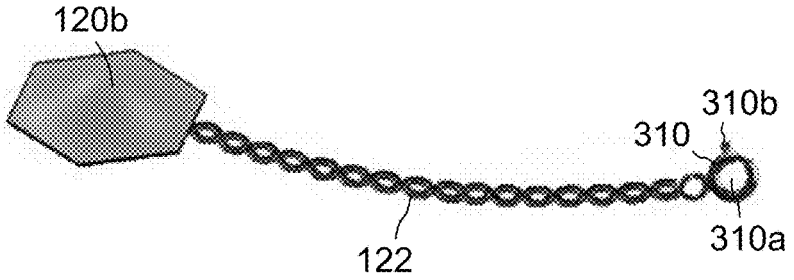
FIG. 3 is a perspective view of another example first fastener, where the element of the first fastener is coupled to a ring via a chain or cord.

FIGS. 2 and 3 show example arrangements for securing the fastener element 120*b*. In FIG. 2, the chain or cord 122 connects the element 120*b* to the take-up component 150 via a fixed attachment 210. The fixed attachment 210 may be realized, for example, using a ring, hook, anchor, glue, solder, weld, or any other connecting scheme. In FIG. 3, the chain or cord 122 may terminate in a ring 310 having an opening 310*a*. The flexible line 110 passes through the opening 310*a* and is able to translate back and forth within the opening 310*a*. The ring 310 may be placed onto the flexible line 110 by opening the latch 140 and feeding the loose end of the flexible line 110 into the opening 310*a*. In some examples, the ring 310 is a spring ring having a latch 310*b*, which can be opened to facilitate attachment of the ring 310 around the flexible line 110. One should appreciate that the ring 310 may be realized as any enclosed loop having an internal opening 310*a* through which the flexible line 110 may be passed.

Figure 4:
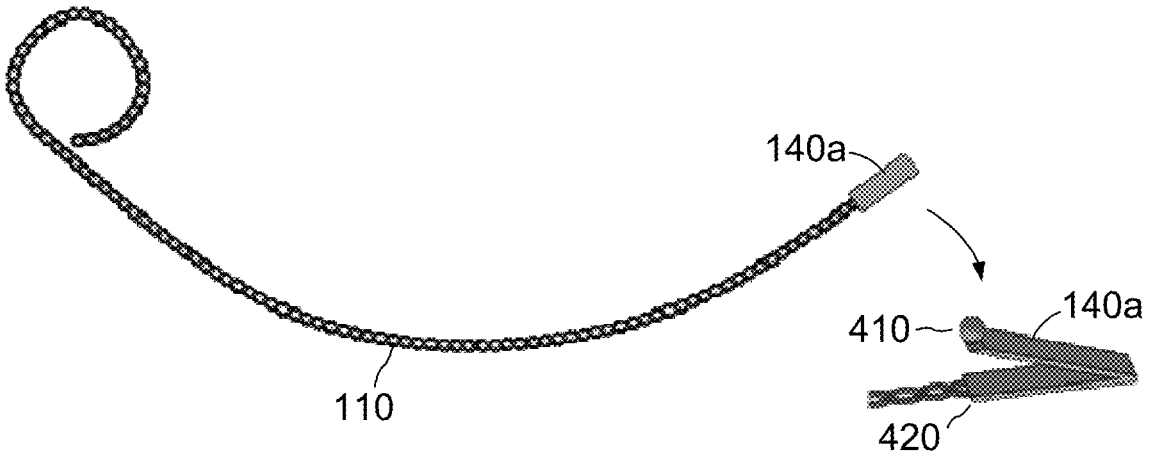
FIG. 4 is a front, plan view of an example flexible line of the adjustable garment closure of FIG. 1.
Figure 5:
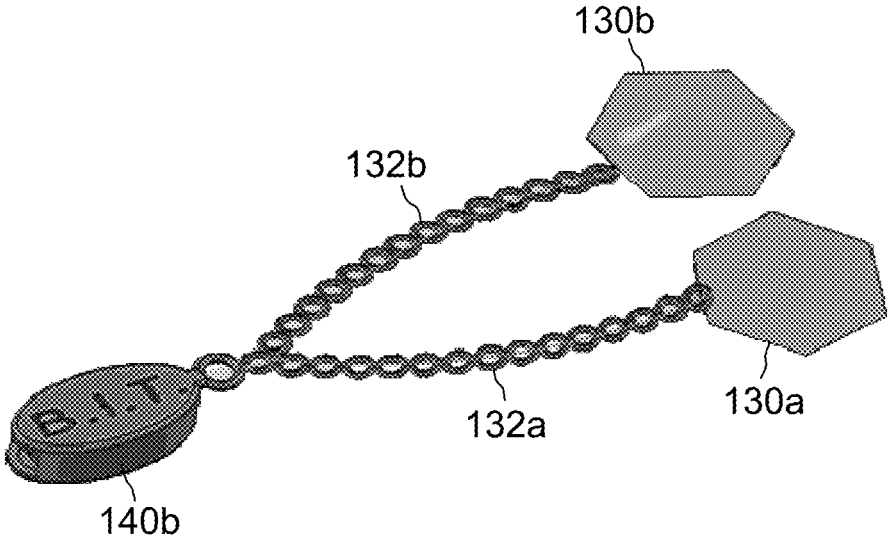
FIG. 5 is a perspective view of an example second fastener of the adjustable garment closure of FIG. 1.

FIGS. 4 and 5 show the flexible line 110 and clasp 140 in additional detail. As illustrated, the flexible line 110 terminates in the male part (tab) 140*a* of the clasp 140 (FIG. 1). The tab 140*a* may be inserted into the female part 140*b*, where it snaps in place to form a latched engagement. The tab 140*a* may be removed from the female part 140*b* by squeezing ends 410 and 420 of the tab 140*a* together and pulling.

Figure 6:
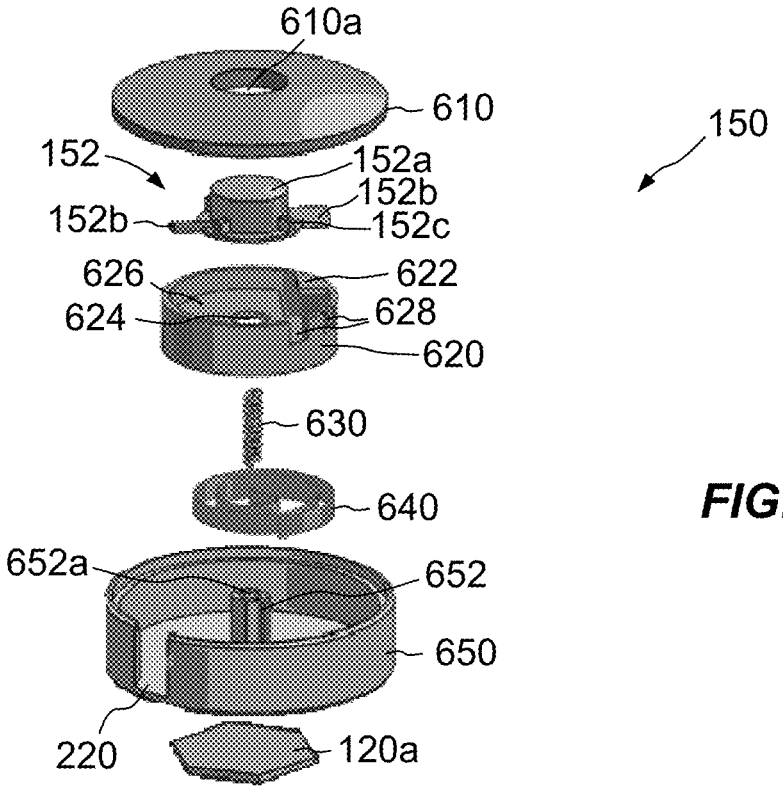
FIGS. 6, 7, 8, 9, and 10*a*-10*c* are various views of the example take-up component of FIGS. 1-3.
Figure 7:
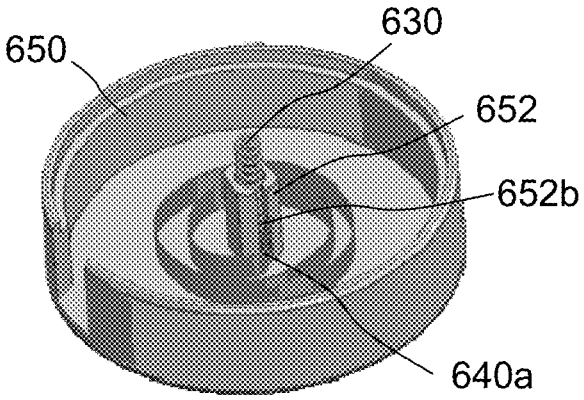
Figure 8:
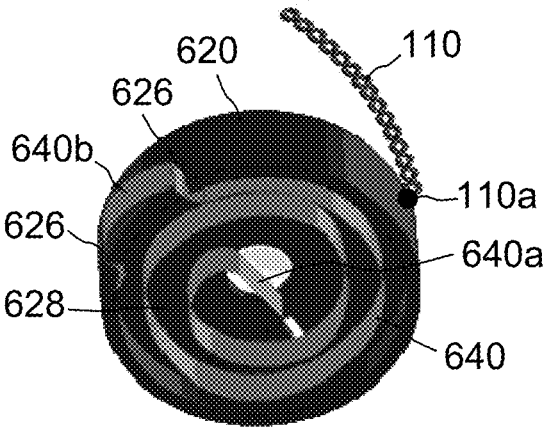
Figure 9:
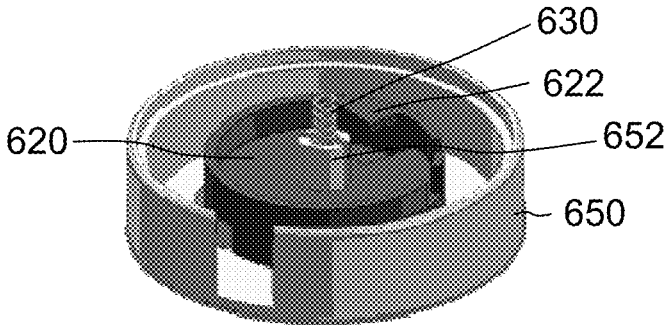
Figure 10A:
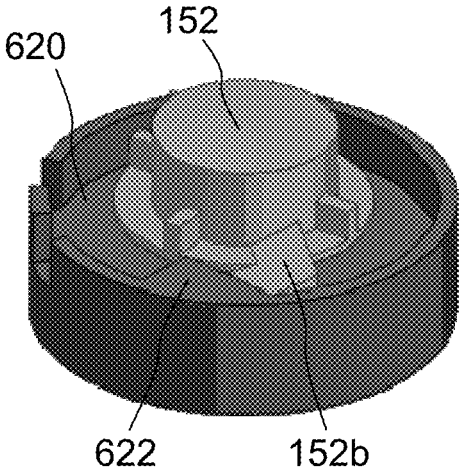
Figure 10B:
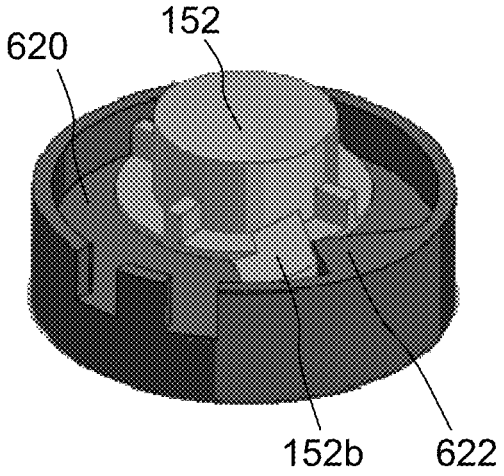
Figure 10C:
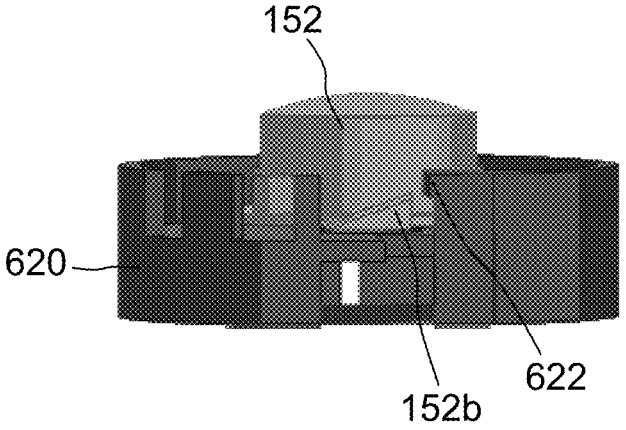

FIGS. 6, 7, 8, 9, and 10*a*-10*c* show example parts of the take-up component 150 in additional detail. As seen in FIG. 6, the take-up component 150 has a housing that includes a base 650 and a lid 610. The base 650 has a central shaft 652 that extends up from a bottom of the base 650 and includes an axial hole 652*a*. The hole 652*a* is adapted for receiving a compression spring 630, which extends from the base 650 to an underside of the button 152. A spindle 620 sits within the base 650 and has a central clearance hole 624 that fits around the shaft 652, thereby supporting rotation of the spindle 620 about the shaft 652. The spindle 620 has a deck 626 that divides the height of the spindle 620 into upper and lower regions. The upper region receives the button 152 and the lower region receives a coil spring 640. The coil spring 640 has an internal end 640*a* that engages a slot 652*b* in the shaft 652 (FIG. 7) and an external end 640*b* that engages a pair of openings 626 in the spindle 620 (FIG. 8). The pictured arrangement enables the coil spring 640 to wind when the spindle 620 is rotated in one direction and to unwind when the spindle 620 is rotated in the opposite direction.

As shown in FIG. 8, the first end 110*a* of the flexible line 110 connects to a side of the spindle 620. The components are arranged such that the coil spring 640 applies a retracting force that tends to pull the flexible line 110 into the take-up component 650 as the coil spring 640 unwinds.

As best seen in FIG. 6, the button 152 includes a main body 152*a*, two spokes 152*b*, and four ribs 152*c*. The main body 152*a* extends up through a hole 610*a* in the lid 610, where the button 152 is accessible to the user. The spokes 152*b* are oriented at angles to form ramps.

In assembled operation, the compression spring 630 biases the button 152 to an up-position in which ribs 152*c* engage tabs (not shown) on the underside of the lid 610, preventing rotation of the button 152. With the button 152 in the up-position (i.e., a first configuration), the spindle 620 is free to rotate counterclockwise (from the FIG. 6 perspective), against the pull of the coil spring 640. However, the spindle 620 is blocked from rotating clockwise, in compliance with the pull of the coil spring 640, i.e., by interference of a lock tab 622 on the spindle 620 with one of the spokes 152*b*. The lock tab 622 is a shallow structure, however, such that pushing the button 152 to a down-position (i.e., a second configuration) enables the spokes 152*b* to clear the lock tab 622 and allows the spindle 620 to rotate freely in both directions. Assuming no external force, pushing the button causes the coil spring 640 to retract the flexible line 110 into the take-up component 150.

With this arrangement, the user can pull on the flexible line 110 to release more line from the take-up component 150, regardless of the position of the button 152. But the user must push the button 152 to the down-position in order to retract line into the take-up component 150.

Figure 11:
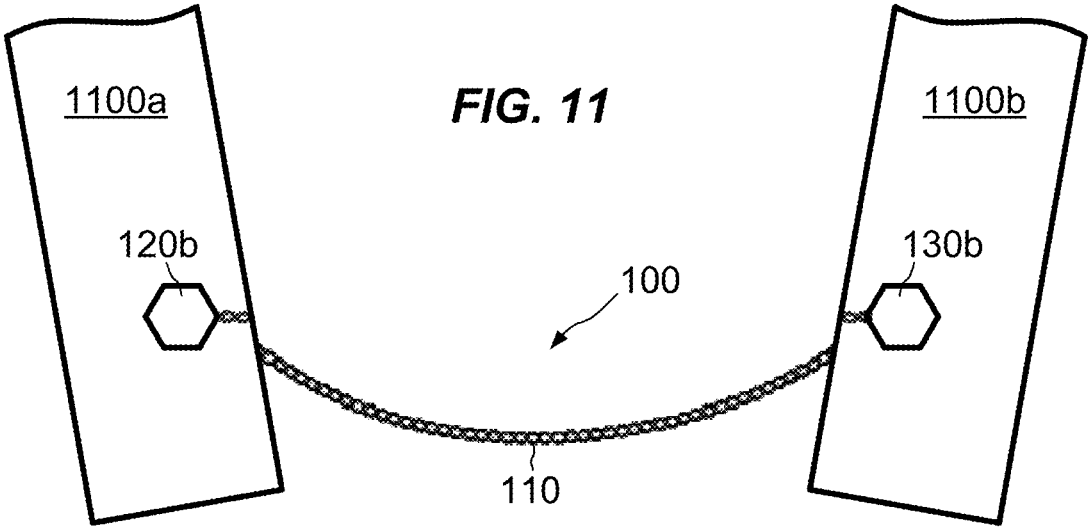
FIG. 11 is a front view of an example adjustable garment closure of FIG. 1, shown in use to achieve adjustable closure of two garment portions.

FIG. 11 shows a simplified example of the adjustable garment closure 100 in use. Here, garment portions 1100*a* and 1100*b* are right and left parts of a single garment, such as a sweater, prayer shawl, scarf, or the like. Fastener elements 120*b* and 130*b* face forward, while elements 120*a* and 130*a* are concealed behind the respective garment portions. Take-up component 150 is concealed behind garment portion 1100*a*. Magnetic attraction between elements 120*a* and 120*b*, and between elements 130*a* and 130*b*, hold the garment closure 100 in place by friction.

To assume the arrangement shown in FIG. 11, the user may put on the garment, attach the first fastener 120 to the right garment portion 1100*a*, attach the second fastener 130 to the left garment portion 1100*b*, and operate the button 152 on the take-up component 150 to establish the desired exposed length of the flexible line 110.

Figure 12:
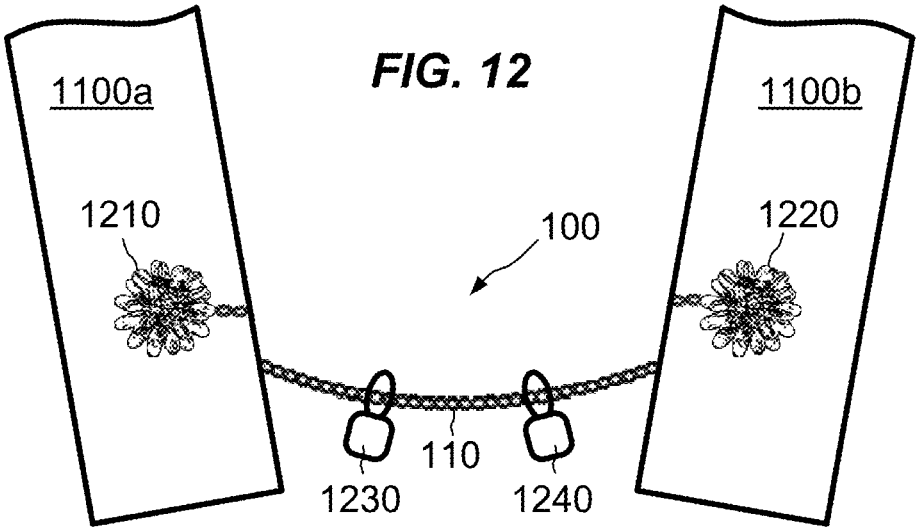
FIG. 12 is a front view of another adjustable garment closure of FIG. 1, as shown in use and adorned with jewelry items.

FIG. 12 is similar to FIG. 11, but here the adjustable closure 100 is adorned with jewelry or other decorative items. For example, jewelry item 1210 has been attached (buttoned, snapped, adhered, etc.) to element 120*b*, and jewelry item 1220 has been attached to element 130*b*. In addition, the adjustable closure 100 may be adorned with charms 1230 and 1240 or other ornaments, to achieve an even more decorative and fanciful appearance.

An improved technique has been described for closing garments. The technique provides a flexible line 110 and a take-up component 150. The flexible line 110 has a first end 110*a* and a second end 110*b*. Each end of the flexible line 110 is coupled to a respective fastener 120 or 130. Each fastener is configured to attach to a respective garment portion 1100*a* or 1100*b*, such as left and right sides of a sweater, prayer shawl, scarf, or the like. The take-up component 150 contains a segment 110*c* of the flexible line and is adjustable to vary the segment's length. In this manner, a person can attach the two fasteners 120 and 130 and adjust the take-up component 150 to vary a degree of closure between the garment portions.

Having described certain embodiments, numerous alternative embodiments or variations can be made. For example, the garment portions 1100*a* and 1100*b* have been described as right and left sides of the same garment. This is not required, however. For example, the garment portions 1100*a* and 1100*b* may alternatively be parts of different garments, which a user may join and/or bring closer together in a fashionable manner. In another example, the garment portions 1100*a* and 1100*b* may be portions of excess fabric, e.g., at the front or back of a garment, which are fashionably attached using the adjustable garment closure 100. In still further examples, the adjustable garment closure may be used to join and/or bring together other types of fabrics, including non-garment fabrics, such as draperies, blinds, tapestries, and the like.

Also, one should appreciate that the second end 110*b* of the flexible line 110 may be coupled to the second fastener 130 via any number of intermediate pieces. For example, a rigid jewelry item, such as a brooch, bar, tag, or the like, may be inserted between the second end 110*b* and the second fastener 130, e.g., in line with the clasp 140. In some examples, any such intermediate pieces may remain exposed even after the flexible line 110 is maximally retracted.

Further, although features are shown and described with reference to particular embodiments hereof, such features may be included and hereby are included in any of the disclosed embodiments and their variants. Thus, it is understood that features disclosed in connection with any embodiment are included as variants of any other embodiment.

As used throughout this document, the words "comprising," "including," "containing," and "having" are intended to set forth certain items, steps, elements, or aspects of something in an open-ended fashion. Also, as used herein and unless a specific statement is made to the contrary, the word "set" means one or more of something. This is the case regardless of whether the phrase "set of" is followed by a singular or plural object and regardless of whether it is conjugated with a singular or plural verb. Further, although ordinal expressions, such as "first," "second," "third," and so on, may be used as adjectives herein, such ordinal expressions are used for identification purposes and, unless specifically indicated, are not intended to imply any ordering or sequence. Thus, for example, a second event may take place before or after a first event, or even if no first event ever occurs. In addition, an identification herein of a particular element, feature, or act as being a "first" such element, feature, or act should not be construed as requiring that there must also be a "second" or other such element, feature or act. Rather, the "first" item may be the only one. Although certain embodiments are disclosed herein, it is understood that these are provided by way of example only and that the invention is not limited to these particular embodiments.

Those skilled in the art will therefore understand that various changes in form and detail may be made to the embodiments disclosed herein without departing from the scope of the invention.

What is claimed is:

1. An adjustable garment closure, comprising:

a flexible line composed of a chain or cord, the flexible line having a first end and a second end;

a first fastener coupled to the first end of the flexible line, the first fastener configured to attach the first end of flexible line to a first garment portion;

a second fastener coupled to the second end of the flexible line, the second fastener configured to attach the second end of the flexible line to a second garment portion; and a take-up component coupled to the flexible line and containing a segment of the flexile line, the take-up component being adjustable to vary a length of the segment contained by the take-up component and thereby to effect a variable closure of the first garment portion relative to the second garment portion, wherein the first fastener includes a first element and a second element, the first element and the second element configured to engage with each other while the first garment portion is held between the first element and the second element, wherein the first element is affixed to or integral with the take-up component, and wherein the second element is coupled, via a second chain or cord, to at least one of (i) the take-up component and (ii) the flexible line.

2. The adjustable garment closure of claim 1, wherein the second or cord has a first end coupled to the second element and a second end terminated in a ring, the ring having an opening that transversely surrounds the flexible line, such that the flexible line is free to translate axially within the opening of the ring.

3. The adjustable garment closure of claim 1, wherein the second chain or cord is shorter than the flexible line and matches the flexible line in its composition and design.

4. The adjustable garment closure of claim 1, wherein the second element includes a jewelry portion that faces away from the first element when the first element and the second element are engaged with each other.

5. The adjustable garment closure of claim 4, wherein the jewelry portion is removable and can be replaced with other jewelry portions of different design.

6. The adjustable garment closure of claim 4, wherein the second fastener includes:

a first fastener element coupled to the second end of the flexible line; and a second fastener element coupled to the second end of the flexible line, the first fastener element and the second fastener element configured to engage with each other while the second garment portion is held between the first fastener element and the second fastener element.

7. The adjustable garment closure of claim 6, wherein the first fastener element is coupled to the second end of the flexible line via a first segment, wherein the second fastener element is coupled to the second end of the flexible line via a second segment, and wherein first segment and the second segment are each shorter than the flexible line and match the flexible line in their composition and design.

8. The adjustable garment closure of claim 7, further comprising a clasp, the clasp having a first portion coupled to both the first fastener element and the second fastener element and a second portion coupled to the second end of the flexible line, the first portion and the second portion of the clasp configured to selectively engage and disengage for respectively closing and opening the clasp.

9. The adjustable garment closure of claim 8, wherein the second fastener element includes a second jewelry portion that faces away from the first fastener element when the first fastener element and the second fastener element are engaged with each other.

10. The adjustable garment closure of claim 1, wherein the take-up component includes:

a housing;

a coil spring within the housing, the coil spring applying a retracting force to the flexible line, the retracting force tending to retract the flexible line into the housing; and a release mechanism having (i) a first configuration that blocks the flexible line from retracting into the housing and (ii) a second configuration that allows the flexible line to retract into the housing in compliance with the retracting force, wherein the release mechanism includes a control that extends from inside the housing to outside the housing and enables a person to adjust the release mechanism between the first configuration and the second configuration for adjusting the length of the segment of the flexible line contained by the take-up component.

11. The adjustable garment closure of claim 10, wherein the control of the release mechanism includes a button coupled to a compression spring, the compression spring configured (i) to bias the button to an up-position to establish the first configuration of the release mechanism and (ii) to allow the button to be compressed to a down-position to establish the second configuration of the release mechanism.

12. The adjustable garment closure of claim 11, wherein the take-up component further includes:

a central shaft disposed within the housing; and a spindle having a central hole through which the central shaft is passed, wherein the coil spring has an internal end coupled to the central shaft and an external end coupled to the spindle, such that the spindle is free to rotate about the central shaft as the coil spring compresses and expands, wherein the button includes a set of button spokes disposed inside the housing, the button spokes extending radially outward from a main body of the button and oriented at angles, such that each button spoke forms a ramp, and wherein the spindle includes a spindle lock tab configured to engage the ramp of each of the set of button spokes such that each ramp blocks rotation of the spindle in compliance with the retracting force and allows rotation of the spindle against the retracting force.

13. An adjustable garment closure, comprising:

a flexible line composed of a chain or cord, the flexible line having a first end and a second end;

a first fastener coupled to the first end of the flexible line, the first fastener configured to attach the first end of the flexible line to a first garment portion;

a second fastener coupled to the second end of the flexible line, the second fastener configured to attach the second end of the flexible line to a second garment portion; and a take-up component affixed to or integral with at least a portion of the first fastener, the take-up component containing a segment of the flexible line and being adjustable to vary a length of the segment contained by the take-up component and thereby to effect a variable closure of the first garment portion relative to the second garment portion, wherein the first fastener includes a first element and a second element, the first element and the second element configured to engage with each other while the first garment portion is held between the first element and the second element, wherein the first element is affixed to or integral with the take-up component, and wherein the second element is coupled, via a second chain or cord, to at least one of (i) the take-up component and (ii) the flexible line.

14. The adjustable garment closure of claim 13, further comprising:

a first jewelry item affixed to or integral with the first fastener; and a second jewelry item affixed to or integral with the second fastener.

15. The adjustable garment closure of claim 14, further comprising a set of charms coupled to the flexible line along a portion of the flexible line not contained by the take-up component.

16. A method of applying a flexible garment closure, the method comprising:

attaching a first fastener to a first garment portion, the first fastener coupled to a first end of a flexible line, the flexible line composed of a chain or cord;

attaching a second fastener to a second garment portion, the second fastener coupled to a second end of the flexible line; and adjusting a take-up component coupled to the flexible line to vary a length of a segment of the flexible line contained by the take-up component, wherein adjusting the take-up component effects a variable closure of the first garment portion relative to the second garment portion, wherein the first fastener includes a first element and a second element, the first element and the second element configured to engage with each other while the first garment portion is held between the first element and the second element, wherein the first element is affixed to or integral with the take-up component, and wherein the second element is coupled, via a second chain or cord, to at least one of (i) the take-up component and (ii) the flexible line.

17. The method of claim 16, wherein the first garment portion and the second garment portion are respective portions of a single garment.

18. The method of claim 17, wherein adjusting the take-up component includes pushing a button extending from the take-up component to effect partial retraction of the flexible line into the take-up component.

* * * * *